US011149326B2

(12) United States Patent
Yi et al.

(10) Patent No.: US 11,149,326 B2
(45) Date of Patent: Oct. 19, 2021

(54) HIGH-STRENGTH AND HIGH-MANGANESE STEEL HAVING EXCELLENT LOW-TEMPERATURE TOUGHNESS AND MANUFACTURING METHOD THEREFOR

(71) Applicant: POSCO, Pohang-si (KR)

(72) Inventors: Il-Cheol Yi, Gwangyang-si (KR); Jae-Yong Chae, Gwangyang-si (KR); Sang-Deok Kang, Gwangyang-si (KR); Jae-Young Cho, Gwangyang-si (KR); Hong-Yeol Oh, Gwangyang-si (KR); Tae-Il So, Gwangyang-si (KR)

(73) Assignee: POSCO, Pohang-si (KR)

( * ) Notice: Subject to any disclaimer, the term of this patent is extended or adjusted under 35 U.S.C. 154(b) by 80 days.

(21) Appl. No.: 16/339,851

(22) PCT Filed: Oct. 19, 2017

(86) PCT No.: PCT/KR2017/011590
§ 371 (c)(1),
(2) Date: Apr. 5, 2019

(87) PCT Pub. No.: WO2018/080108
PCT Pub. Date: May 3, 2018

(65) Prior Publication Data

US 2020/0040418 A1 Feb. 6, 2020

(30) Foreign Application Priority Data

Oct. 25, 2016 (KR) ..... 10-2016-0138994

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/005* (2013.01); *C21D 6/008* (2013.01); *C21D 8/0205* (2013.01);
(Continued)

(58) Field of Classification Search
None
See application file for complete search history.

(56) References Cited

U.S. PATENT DOCUMENTS

2010/0263773 A1 10/2010 Cho et al.
2011/0226393 A1 9/2011 Senuma et al.
(Continued)

FOREIGN PATENT DOCUMENTS

CN 101868560 A 10/2010
CN 103060678 A 4/2013
(Continued)

OTHER PUBLICATIONS

Chinese Office Action dated Jul. 3, 2020 issued in Chinese Patent Application No. 201780065520.2 (with English ranslation).
(Continued)

*Primary Examiner* — Brian D Walck
(74) *Attorney, Agent, or Firm* — Morgan, Lewis & Bockius LLP

(57) ABSTRACT

An aspect of the present invention relates to a high-strength and high-manganese steel having excellent low-temperature toughness, the high-strength and high-manganese steel comprising, in terms of wt %, 4.3-5.7% of manganese (Mn), 0.015-0.055% of carbon (C), 0.015-0.05% silicon (Si), 0.6-1.7% of aluminum (Al), 0.01-0.1% of niobium (Nb), 0.015-0.055% of titanium (Ti), 0.001-0.005% of boron (B), 0.03% or less of phosphor (P), 0.02% or less of sulfur (S), and the balance iron (Fe) and other inevitable impurities, wherein the microstructure thereof comprises, in terms of percent by
(Continued)

volume, 40-60% of martensite and 40-60% of tempered martensite.

5 Claims, 1 Drawing Sheet

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |

(52) U.S. Cl.
CPC ..... *C21D 8/0226* (2013.01); *C21D 8/0263* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C21D 2211/008* (2013.01)

(56) References Cited

U.S. PATENT DOCUMENTS

| | | | |
|---|---|---|---|
| 2013/0292011 | A1 | 11/2013 | Kim et al. |
| 2014/0083574 | A1 | 3/2014 | Nam et al. |
| 2014/0205855 | A1 | 7/2014 | Kawata et al. |
| 2014/0308156 | A1 | 10/2014 | Oh et al. |
| 2016/0167157 | A1 | 6/2016 | Perlade et al. |
| 2017/0130286 | A1 | 5/2017 | Hayashi |

FOREIGN PATENT DOCUMENTS

| | | | |
|---|---|---|---|
| CN | 103343281 | A | 10/2013 |
| CN | 103403204 | A | 11/2013 |
| JP | H06-184630 | A | 7/1994 |
| JP | 2007-146275 | A | 6/2007 |
| JP | 2010-070806 | A | 4/2010 |
| JP | 2016-531200 | A | 10/2016 |
| KR | 10-2001-0024757 | A | 3/2001 |
| KR | 10-2010-0070639 | A | 6/2010 |
| KR | 10-1094310 | B1 | 12/2011 |
| KR | 10-2012-0071583 | A | 7/2012 |
| KR | 10-2012-0071585 | A | 7/2012 |
| KR | 10-2013-0050138 | A | 5/2013 |
| KR | 10-2014-0141842 | a | 12/2014 |
| WO | 99/32672 | A1 | 7/1999 |
| WO | 2013/018740 | A1 | 2/2013 |
| WO | 2016/010144 | A1 | 1/2016 |

OTHER PUBLICATIONS

International Search Report dated Jan. 19, 2018 issued in International Patent Application No. PCT/KR2017/011590 (with English translation).

Japanese Office Action dated Apr. 14, 2020 issued in Japanese Patent Application No. 2019-518100.

HIGH-STRENGTH AND HIGH-MANGANESE STEEL HAVING EXCELLENT LOW-TEMPERATURE TOUGHNESS AND MANUFACTURING METHOD THEREFOR

CROSS-REFERENCE OF RELATED APPLICATIONS

This application is the U.S. National Phase under 35 U.S.C. § 371 of International Patent Application No. PCT/KR2017/011590, filed on Oct. 19, 2017, which in turn claims the benefit of Korean Patent Application No. 10-2016-0138994, filed Oct. 25, 2016, the entire disclosures of which applications are incorporated by reference herein.

TECHNICAL FIELD

The present disclosure relates to a high-strength and high-manganese steel having excellent low-temperature toughness for use in a structural steel.

BACKGROUND ART

It is known that a martensitic structural steel having high strength is difficult to use as a structural steel at a low temperature because toughness of the martensitic structural steel is rapidly reduced due to ductile-brittle transition occurring as a temperature is decreased. In the case of a high-manganese steel containing a large amount of manganese in a chemical composition thereof, use of the high-manganese steel has been limited due to dominant grain boundary embrittlement in which fracture toughness is poorest.

In general, a high-hardness steel includes high amounts of carbon and high amounts of alloying elements, and a quenching process is essential for securing a martensitic structure capable of providing sufficient strength.

However, as a steel sheet increases in thickness, it becomes more difficult to secure a high cooling rate of a central portion of a thick steel plate. Therefore, the content of an alloying element improving hardenability has been increased.

Manganese, an alloying element improving hardenability, may improve hardenability at a low cost. However, use of manganese has been limited due to grain boundary embrittlement caused by manganese. In addition, high-cost elements such as chromium, molybdenum, nickel, and the like are mainly used to increase the manufacturing cost.

In general, a 9Ni steel is a typical high-strength steel widely used as a low-temperature structural steel. For example, Patent Document 1 discloses a method of manufacturing a 9Ni steel having a thickness of 40 millimeters (mm) or more using a quenching-tempering (QT) method or a direct quenching-tempering (DQ-T) method.

Although a 9Ni steel is advantageous in securing sufficient martensite microstructure and high strength due to high hardenability of high content of nickel (Ni) and achieving a ductile-brittle transition temperature (DBTT) of a parent material, Ni prices may be excessively high and volatile, such that there has been a continuous need for development of alternative steels.

Moreover, as the use environment of construction and civil engineering equipment and mining equipment is expanding to colder regions, a structural steel, exhibiting a soft fracture behavior even at low temperature, is required. Accordingly, there is a need to secure excellent toughness at low temperature.

As a result, there is a need to develop a high-strength and high-manganese steel, having excellent low-temperature toughness, which may secure low-temperature toughness and high strength at a low cost and prevent grain boundary embrittlement to be used in a structural steel, and a method of manufacturing the high-strength and high-manganese steel.

PRIOR ART DOCUMENT (Patent Document 1) Japanese Laid-Open Patent Publication No. 1994-184630

DISCLOSURE

Technical Problem

An aspect of the present disclosure is to provide a high-strength and high-manganese steel, having excellent low-temperature toughness, for use in a structural steel and a method of manufacturing the high-strength and high-manganese steel.

Technical Solution

According to an aspect of the present disclosure, a high-strength and high-manganese steel having excellent low-temperature toughness includes, in terms of weight percentage (wt %), 4.3 to 5.7% of manganese (Mn), 0.015 to 0.055% of carbon (C), 0.015 to 0.05% of silicon (Si), 0.6 to 1.7% of aluminum (Al), 0.01 to 0.1% of niobium (Nb), 0.015 to 0.055% of titanium (Ti), 0.001 to 0.005% of boron (B), 0.03% or less of phosphor (P), 0.02% or less of sulfur (S), and a balance iron (Fe) and other inevitable impurities. A microstructure of the high-strength and high-manganese steel includes, in terms of volume percentage, 40 to 60% of martensite and 40 to 60% of tempered martensite.

According to another aspect of the present disclosure, a method of manufacturing a high-strength and high-manganese having excellent low-temperature toughness includes heating a slab, including, in terms of weight percentage (wt %), 4.3 to 5.7% of manganese (Mn), 0.015 to 0.055% of carbon (C), 0.015 to 0.05% of silicon (Si), 0.6 to 1.7% of aluminum (Al), 0.01 to 0.1% of niobium (Nb), 0.015 to 0.055% of titanium (Ti), 0.001 to 0.005% of boron (B), 0.03% or less of phosphor (P), 0.02% or less of sulfur (S), and a balance of iron (Fe) and other inevitable impurities, and hot-rolling the heated slab to obtain a hot-rolled steel sheet, cooling the hot-rolled steel sheet in such a manner that a cooling rate is greater than or equal to 3 degrees Celsius per second (° C./sec) in a temperature period of Ar3 to 200° C., and performing an intercritical annealing process in which the cooled hot-rolled steel sheet is heated within a temperature range of ((Ac1+Ac3)/2+30° C.) to ((Ac1+Ac3)/2−30° C.) and then cooled.

Advantageous Effects

According to the present disclosure, there is an effect of providing a high-strength and high-manganese steel, having high strength and low DBTT while using a lower amount of carbon and other high-cost alloying elements, and a method of manufacturing the same.

BEST MODE FOR INVENTION

Figure 1:
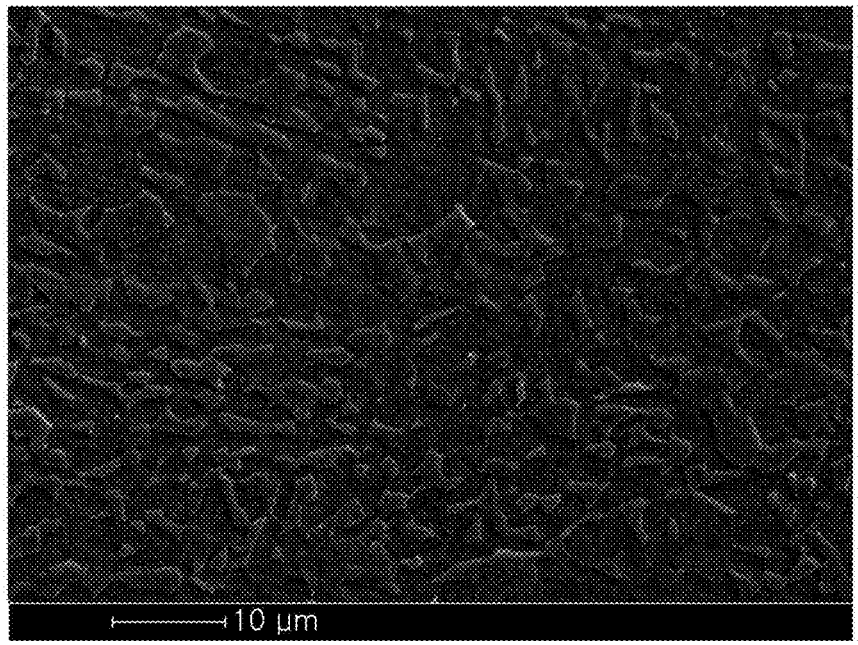
FIG. 1 is a scanning electron microscope (SEM) image of a microstructure of Test No. 5-1 which is an inventive example.

Hereinafter, exemplary embodiments of the present disclosure will be described. However, embodiments of the present disclosure may be modified to various other forms, and the scope of the present disclosure is not limited to the embodiments described below. In addition, embodiments of the present disclosure are provided for more completely describing the present disclosure to those skilled in the art.

The present inventors have intensively researched to provide a high-strength and high-manganese steel having excellent low-temperature toughness which may be used for a structural steel because grain boundary embrittlement does not occur while securing low-temperature toughness and high strength at low cost, and a manufacturing method of the high-strength and high-manganese steel.

As a result, there was a conclusion that high ductility-brittle transition temperature (hereinafter referred to as "DBTT") and grain boundary embrittlement occurred because a grain boundary becomes relatively weaker than a grain interior as the content of manganese (Mn) increased in a martensite microstructure of the high manganese steel. In addition, a chemical composition was selected to strengthen a grain boundary of a martensite or to achieve a balance between the grain boundary and the grain interior, and a suitable manufacturing process was selected to achieve a fine grain size and the microstructure was controlled to include martensite and tempered martensite. Accordingly, it has been found that DBTT might be significantly reduced while maintaining high strength of a martensitic high-manganese steel, and the present disclosure has been completed.

A related-art martensitic high-strength steel is manufactured from a thermo-mechanical control process (TMCP) steel produced by performing hot-rolling after performing quenching at a controlled cooling rate, or from a reheating quenching treatment (RQ) steel produced by performing cold-rolling after hot rolling and further performing quenching after performing annealing at a temperature of Ac3 or higher. Additionally, the related-art martensitic high-strength steel may follow a format of a quenching and tempering treatment (QT) steel plate. In the case in which a high-manganese (Mn) steel is manufactured using a related-art process, a TMCP steel may have low toughness or high DBTT in a specific direction because grain boundary fracture is accelerated along an elongated grain boundary. A RQ or QT steel may also have low toughness or high DBTT because a grain boundary is formed to be large and flat.

To address the high DBTT, a method of manufacturing a dual-phase steel of a ferrite-martensite structure through intercritical annealing may be worth consideration. Such a steel undergoes intercritical annealing. In such a steel, two or more phases, separating existing grains, may be mixed. For this reason, a structure becomes finer and the DBTT may be reduced. However, there is a disadvantage in that strength may be more significantly reduced by introducing a ferrite phase than in an existing martensitic steel.

In the case of a high-Mn steel, both a first phase, formed before annealing, and a second phase, formed after the annealing, may be transformed into a martensite phase by high hardenability of a high content of Mn although a grain size is reduced by dividing an existing grain during two-phase annealing. Accordingly, immediately after hot rolling, the martensite phase is transformed into the first phase through quenching, the first phase is transformed into a tempered martensite through two-phase annealing, and the second phase is transformed into a general martensite phase through the austenite phase after second quenching. In this case, in order to balance strengths between a grain boundary and a grain interior, an appropriate amount of alloying elements such as titanium (Ti), niobium (Nb), aluminum (Al), boron (B), and the like, grain boundary strengthening elements, may be added to obtain a low DBTT in the high-Mn steel due to a significantly finer microstructure than a related-art microstructure. As a result, a low-cost high-strength and high-Mn steel having excellent strength and low DBTT may be developed in spite of exclusion of carbon, deteriorating physical properties of a welded portion, and expensive elements such as molybdenum (Mo), chromium (Cr), nickel (Ni), and the like.

High-Strength and High-Manganese Steel Having Excellent Low-Temperature Toughness Hereinafter, a high-strength and a high-manganese steel having excellent low-temperature toughness according to an aspect of the present disclosure will be described in detail.

A high-strength and high-manganese steel having excellent low-temperature toughness according to an aspect of the present disclosure includes, in terms of weight percentage (wt %), 4.3 to 5.7% of manganese (Mn), 0.015 to 0.055% of carbon (C), 0.015 to 0.05% of silicon (Si), 0.6 to 1.7% of aluminum (Al), 0.01 to 0.1% of niobium (Nb), 0.015 to 0.055% of titanium (Ti), 0.001 to 0.005% of boron (B), 0.03% or less of phosphor (P), 0.02% or less of sulfur (S), and a balance of iron (Fe) and inevitable impurities. A microstructure of the high-strength and high-manganese steel includes, in terms of percent by volume, 40 to 60% of martensite and 40 to 60% of tempered martensite.

First, an alloy composition of the present disclosure will be described in detail. Hereinafter, the content of each element is in weight percentage (wt %) unless otherwise specified.

Manganese (Mn): 4.3 to 5.7%

Manganese (Mn) is one of the most important elements added in the present disclosure and serves to stabilize martensite to easily secure a stable martensite structure in a cooling process after hot rolling or intercritical annealing.

In detail, manganese (Mn) is contained in an amount of 4.3% or more to stabilize martensite in consideration of the range of other alloying elements of the present disclosure. When the content of Mn is less than 4.3%, ferrite or bainite having a small grain size may be easily formed at a slow cooling rate, and thus, desired high strength cannot be obtained.

On the other hand, when the content of Mn is greater than 5.7%, weldability may be significantly reduced and steel manufacturing cost is increased.

Accordingly, the content of Mn may be, in detail, 4.3 to 5.7% and, in further detail, 4.5 to 5.5%.

Carbon (C): 0.015 to 0.055%

Carbon (C) exhibits similar effects to manganese (Mn) in terms of facilitation to secure strength of a steel and to reduce toughness and weldability. Accordingly, since an optimal carbon content range depends on the content of manganese (Mn), a composition range, in which the effect of the present disclosure is significantly increased, is limited. In detail, 0.015% or more of carbon is added to sufficiently secure the strength that the present disclosure requires. However, since toughness is significantly reduced when an excessively large amount of carbon is added, an upper limit is, in detail, 0.055%. Accordingly, the content of carbon may be, in detail, 0.015 to 0.055% and, in further detail, 0.02 to 0.05%.

Silicon (Si): 0.015 to 0.05%

Silicon (Si) is an element serving as a deoxidizer and improves strength depending on solid solution strengthening.

When the content of Si is less than 0.015%, the above effect is insufficient. When the content of Si is greater than 0.05%, toughness of a base material as well as a welded portion may be reduced. Accordingly, the content of Si may be, in detail, 0.015 to 0.05% and, in further detail, 0.02 to 0.05%.

Aluminum (Al): 0.6 to 1.7%

Aluminum (Al) is added as deoxidizer, similarly to silicon (Si). Moreover, aluminum contributes to miniaturization of a structure and has improved solid solution strengthening to be useful to secure strength. Since an alloy composition system according to the present disclosure is effective in suppressing grain boundary fracture of a high-manganese steel and improving low-temperature toughness, it is necessary to appropriately control a ratio thereof.

When the content of Al is less than 0.6%, it is difficult to secure high strength and low DBTT. On the other hand, when the content of Al is greater than 1.7%, the toughness may be significantly reduced in proportion to increasing strength. Accordingly, the content of Al may be, in detail, 0.6 to 1.7%, in further detail, 0.7 to 1.6%, and, in still further detail, 0.6 to 1.5%.

Niobium Nb): 0.01 to 0.1%

Niobium (Nb) is an element which may increase strength through solid solution and precipitation strengthening effects, refine grains during low-temperature rolling to improve impact toughness, and strengthen a grain boundary weakened by manganese.

When the content of Nb is less than 0.01%, the above effect is insufficient. When the content of Nb is greater than 0.1%, coarse precipitates are produced to deteriorate hardness and impact toughness. Accordingly, the content of Nb may be, in detail, 0.01 to 0.1% and, in further detail, 0.02 to 0.09%.

Titanium (Ti): 0.015 to 0.055%

Titanium (Ti) is an element which may significantly increase the effect of boron (B), important to improve hardenability. A titanium nitride (TiN) is formed to suppress formation of a boron nitride (BN) such that the content of solid solution boron (B) is increased to improve the hardenability, to pin precipitated TiN pins austenite grains to suppress grain boundary coarsening, and to significantly suppress grain boundary fracture in the high-manganese steel.

When the content of Ti is less than 0.015%, the above effect is insufficient. When the content of Ti is greater than 0.055%, toughness deterioration or the like may occur due to coarsening of the titanium precipitate. Accordingly, the content of Ti may be, in detail, 0.015 to 0.055% and, in further detail, 0.02 to 0.05%.

Boron (B): 0.001 to 0.005%

Boron (B) is an element, which may effectively increase hardenability of a material even when a small amount of boron is added, and has an effect of suppressing grain boundary fracture through grain boundary strengthening.

When the content of boron (B) is less than 0.001%, the above effect is insufficient. When the content of boron (B) is greater than 0.005%, toughness and weldability are deteriorated due to formation of a coarse precipitate or the like. Accordingly, the content of boron (B) may be, in detail, 0.001 to 0.005% and, in further detail, 0.0015 to 0.004%.

Phosphor (P): 0.03% or less

Phosphorus (P) is an enviable impurity element in the present disclosure, and promotes centerline segregation while being segregated to grain boundaries to causes grain boundary fracture and deteriorate low-temperature toughness. Accordingly, the content of phosphor (P) should be significantly decreased. The content of phosphor (P) may be, in detail, 0.03% or less and, in further detail, 0.02% or less.

Sulfur (S): 0.02% or less

Similarly to phosphorus (P), sulfur (S) is an inevitable impurity element in a steel. In particular, in a high-manganese steel, a coarse nonmetallic inclusion of manganese sulfur (MnS) is formed to rapidly reduce ductility and low-temperature toughness and enhance DBTT. Additionally, even a small content of sulfur (S) may cause intergranular fracturing. Accordingly, the content of sulfur (S) should be significantly decreased. The content of sulfur (S) may be, in detail, 0.02% or less and, in further detail, 0.01% or less.

A remainder is iron (Fe). However, in a typical manufacturing process, impurities which are not intended from the raw materials or the surrounding environment may be inevitably incorporated, so that they cannot be excluded. Since any person skilled in the art can know these impurities, their entities are not specifically mentioned in this specification.

In this case, in addition to the above-described alloy composition, tungsten (W): 0.5% or less (excluding 0%) may be further contained.

Tungsten (W) forms a hard carbide such that strength is increased by the precipitation strengthening effect, and the precipitated carbide suppresses coarsening of austenite grains to exhibit a structure refining effect. However, when the content of tungsten (W) is greater than 0.5%, weldability may be reduced and manufacturing costs of a steel may be increased. Accordingly, the content of tungsten (W) is limited to, in detail, 0.5% or less.

Hereinafter, a microstructure of a high-strength and high-manganese steel having excellent low-temperature toughness according to the present disclosure will be described in detail.

The microstructure of the high-strength and high-manganese steel having excellent low-temperature toughness according to the present disclosure includes, in terms of volume percentage, 40 to 60% of martensite and 40 to 60% of tempered martensite.

When the martensite or the tempered martensite is outside of the above-mentioned range, a grain size of one of the martensite and the tempered martensite may be increased to impede a toughness improving effect resulting from the microstructure refinement.

In further detail, the microstructure of the-high strength and high-manganese steel having excellent low-temperature toughness according to the present disclosure may include, in terms of volume percentage, 42 to 55% of martensite and 45 to 68% of tempered martensite.

In this case, the martensite and the tempered martensite may have an average grain size of 15 micrometers (μm) or less.

This is because since DBTT is significantly affected by structure refinement, DBTT may be greater than −60 degrees Celsius (° C.) when the average grain size is greater than 15 μm.

In further detail, the martensite and the tempered martensite may have an average grains size of 10 μm or less.

The high-manganese steel of the present disclosure may have a yield strength of 550 megapascals (MPa) or more and a tensile strength of 650 MPa or more. In detail, the high-manganese steel may be applied to a structural steel by securing such high strength.

The high-manganese steel according to the present disclosure may have a ductile-brittle transition temperature (DBTT) of −60° C. or lower. In detail, the high-manganese steel may be used as a structural steel even in a low temperature environment by securing a low DBTT.

The high manganese steel according to the present disclosure may have an elongation of 12% or more.

Method of Manufacturing High-Strength and High-Manganese Steel Having Low-Temperature Toughness Hereinafter, a method of manufacturing a high-strength and high-manganese steel having excellent low-temperature toughness according to another aspect of the present disclosure will be described in detail.

The method of manufacturing a high-strength and high-manganese steel having excellent low-temperature toughness includes heating a slab having the above-described alloy composition, hot-rolling the heated slab to obtain a hot-rolled steel sheet, cooling the hot-rolled steel sheet in such a manner that a cooling rate in a temperature range of Ar3 to 200° C. is 3° C./sec or more, and performing intercritical annealing on the cooled hot-rolled steel sheet to cool the cooled hot-rolled steel sheet after heating the cooled hot-rolled steel sheet at a temperature range of ((Ac1+Ac3)/2+30° C.) to ((Ac1+Ac3)/2−30° C.).

Slab Heating and Hot Rolling

A slab having the above-described alloy composition is heated, and the heated slab is hot-rolled to obtain a hot-rolled steel sheet. Since typical operating conditions may be applied, it is unnecessary to limit conditions in the slab heating and hot rolling.

For example, the slab may be heated to 1050 to 1200° C. in such a manner that a microstructure of the slab may be phase-transformed into austenite, and the heated slab may be hot-rolled in such a manner that a final hot rolling temperature is 700 to 950° C.

Cooling

The hot-rolled steel sheet is cooled in such a manner that a cooling rate in the temperature range of Ar3 to 200° C. is 3° C./sec or more. In detail, the hot-rolled steel sheet may be quenched through water cooling.

When the cooling rate in the temperature range of Ar3 to 200° C. is less than 3° C./sec, it is difficult to sufficiently secure martensite.

Intercritical Annealing

The cooled hot-rolled steel sheet is heated to a temperature range of ((Ac1+Ac3)/2−30° C.) to ((Ac1+Ac3)/2+30° C.). Through such intercritical annealing, a matrix phase may be transformed into a tempered martensite phase, and a reverse transformed austenite grain may be restrictively grown to refine a typical martensite produced in a subsequent process as it is. Through such structure refinement, a high-manganese steel having a low DBTT may be obtained while maintaining high strength.

This is because when the heating temperature is outside of the above range, a grain size of one of the martensite and the tempered martensite is increased to impede a toughness improving effect resulting from the microstructure refinement.

Accordingly, the heating temperature may be, in detail, ((Ac1+Ac3)/2−30° C.) to ((Ac1+Ac3)/2+30° C.). In further detail, the heating temperature may be ((Ac1+Ac3)/2−20° C.) to ((Ac1+Ac3)/2+20° C.).

Figure 2:
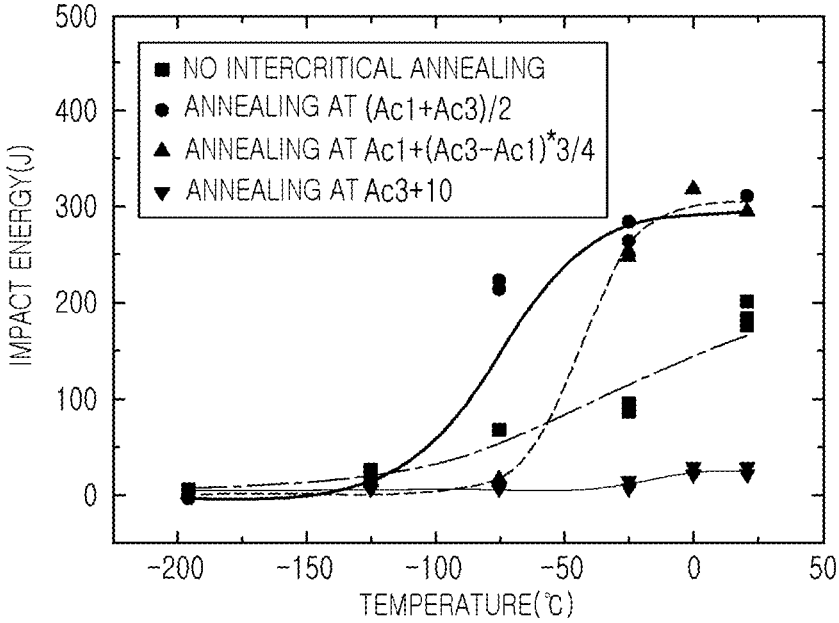
FIG. 2 is a graph illustrating results of a Charpy impact test performed on Test Nos. 5-1 to 5-4 manufactured while varying intercritical annealing conditions.

As illustrated in FIG. 2, it can be seen that DBTT variation depending on an intercritical annealing temperature in the same type of steel has a lowest DBTT at (Ac1+Ac3)/2.

As the content of manganese (Mn), a low-cost element having high-hardenability, increases, a phase is transformed into a martensite phase even in a low cooling rate and a small grain size. Therefore, a martensite structure may be easily obtained even in a fine structure after final annealing. Accordingly, it is advantageous to secure high strength but a grain boundary is weakened to cause grain boundary fracture, which is well known in the art. To prevent or reduce the grain boundary fracture, it is necessary to add an appropriate amount of elements such as Ti, Nb, and B, known as grain boundary strengthening elements, and optimize the content of an element such as Al or the like. As a result, a steel having an improved DBTT may be provided.

The cooling may be performed at a cooling rate of 3° C./sec or more. When the cooling rate is less than 3° C./sec, it is difficult to sufficiently secure martensite.

In addition, intercritical annealing may be performed for (1.3 t+10) minutes to (1.3 t+50) minutes (t being a thickness of the hot-rolled steel sheet measured in a unit of millimeters).

In this case, Ac1 and Ac3 may be obtained using a generally known relational expression.

However, in the case of a high-manganese steel, it may be difficult to predict a difference between an equilibrium phase temperatures Ae1 and Ae3, derived from thermodynamic calculation, and phase-transformation temperatures Ac1 and Ac3 measured when a temperature of an actual steel is increased. Accordingly, for more accurate measurement, the temperatures Ac1 and Ac3 may be measured by observing a slope of length variation of the steel during a rise in temperature in a dilatometer test result graph.

MODE FOR INVENTION

Hereinafter, the present disclosure will be described more specifically according to examples. However, the following examples should be considered in a descriptive sense only and not for purpose of limitation. The scope of the present disclosure is defined by the appended claims, and modifications and variations may reasonably made therefrom.

A slab, having a thickness of 70 mm and having a composition shown in Table (1) below, was heated to 1100° C. and then subjected to finish hot rolling at a finish hot rolling temperature of 800° C. to obtain a hot-rolled steel sheet having a thickness of 11.8 mm. After being cooled at a cooling rate of 10° C./sec in a temperature range of Ar3 to 200° C., the hot-rolled steel sheet was heated to an annealing temperature shown described in Table 2 and then cooled to manufacture a high-manganese steel.

A microstructure of the high-manganese steel was observed and is shown in Table (2) below. Mechanical properties of the high-manganese steel were measured and are shown in Table (3) below.

The microstructure was observed using an optical microscope and a scanning electron microscope (SEM), and a microstructure excluding martensite was tempered martensite. An average grain size was measured as an equivalent circle diameter.

Tensile strength, yield strength, and elongation were measured using a universal tensile tester, and DBTT was measured as a transition temperature of impact toughness at a changed temperature using a Charpy impact tester.

TABLE 1

| TS | C | Si | Mn | Al | B | Ti | Nb | P | S | |
|---|---|---|---|---|---|---|---|---|---|---|
| 1 | 0.03 | 0.02 | 4.5 | 0.8 | 0.002 | 0.05 | 0.04 | 0.01 | 0.002 | IS |
| 2 | 0.03 | 0.02 | 5.5 | 1.5 | 0.002 | 0.02 | 0.04 | 0.01 | 0.002 | IS |
| 3 | 0.02 | 0.02 | 5 | 1 | 0.002 | 0.05 | 0.04 | 0.01 | 0.002 | IS |
| 4 | 0.05 | 0.02 | 5 | 1 | 0.002 | 0.02 | 0.04 | 0.01 | 0.002 | IS |
| 5 | 0.03 | 0.02 | 5 | 1 | 0.002 | 0.05 | 0.04 | 0.01 | 0.002 | IS |
| 6 | 0.03 | 0.02 | 5 | 1 | 0.002 | 0.02 | 0.04 | 0.01 | 0.002 | IS |
| 7 | 0.1 | 0.1 | 6 | 1 | 0.002 | 0.8 | 0.04 | 0.01 | 0.002 | CS |
| 8 | 0.11 | 0.15 | 2 | 0 | 0.002 | 0.01 | 0.2 | 0.01 | 0.002 | CS |
| 9 | 0.02 | 0.02 | 6 | 1 | 0.002 | 0.01 | 0.04 | 0.01 | 0.002 | CS |

*TS: Types of Steel
**IS: Inventive Steel
***CS: Comparative Steel

In Table (1), a unit of each element content is weight percentage.

TABLE 2

| Test No. | TS | Ac1 (° C.) | Ac3 (° C.) | Annealing Temperature (° C.) | Average Grain Size (μm) | Martensite Fraction (vol %) | |
|---|---|---|---|---|---|---|---|
| 1-1 | 1 | 718 | 906 | 812 | 8 | 50 | IE |
| 2-1 | 2 | 696 | 958 | 827 | 6 | 43 | IE |
| 3-1 | 3 | 680 | 917 | 798.5 | 7 | 46 | IE |
| 3-2 | | | | no annealing | 22 | 100 | CE |
| 4-1 | 4 | 731 | 902 | 816.5 | 8 | 43 | IE |
| 5-1 | 5 | 702 | 913 | 807.5 | 7 | 45 | IE |
| 5-2 | | | | no annealing | 22 | 100 | CE |
| 5-3 | | | | 860 | 16 | 80 | CE |
| 5-4 | | | | 923 | 25 | 100 | CE |
| 6-1 | 6 | 703 | 910 | 806.5 | 7 | 44 | IE |
| 7-1 | 7 | 632 | 939 | 785.5 | 6 | 38 | CE |
| 8-1 | 8 | 824 | 858 | 841 | 18 | 56 | CE |
| 9-1 | 9 | 660 | 874 | 767 | 7 | 37 | CE |

*TS: Types of Steel
**IE: Inventive Example
***CE: Comparative Example

TABLE 3

| Test No. | TS | Yield Strength (MPa) | Tensile Strength (MPa) | Elongation Percentage (%) | DBTT (° C.) | |
|---|---|---|---|---|---|---|
| 1-1 | 1 | 602 | 716 | 15.7 | −74 | IE |
| 2-1 | 2 | 667 | 784 | 12.7 | −74 | IE |
| 3-1 | 3 | 583 | 688 | 14.8 | −65 | IE |
| 3-2 | | 645 | 725 | 12.5 | −17 | CE |
| 4-1 | 4 | 718 | 860 | 12.8 | −70 | IE |
| 5-1 | 5 | 627 | 745 | 14.2 | −66 | IE |
| 5-2 | | 691 | 783 | 12.2 | room temperature or higher | CE |
| 5-3 | | 642 | 755 | 13.5 | −42 | CE |
| 5-4 | | 655 | 770 | 11.2 | room temperature or higher | CE |
| 6-1 | 6 | 627 | 745 | 14.0 | −66 | IE |
| 7-1 | 7 | 986 | 1211 | 11.3 | −41 | CE |
| 8-1 | 8 | 465 | 586 | 18.6 | −117 | CE |
| 9-1 | 9 | 619 | 735 | 11.9 | −36 | CE |

*TS: Types of Steel
**IE: Inventive Example
***CE: Comparative Example

It can be confirmed that inventive examples, satisfying both the alloy composition and the manufacturing method proposed in the present disclosure, have yield strength of 550 MPa or more, tensile strength of 650 MPa or more, and a DBTT of −60° C. or less.

It can be confirmed that Test No. 3-2, a comparative example, satisfied the alloy composition of the present disclosure but, as a conventional TMCP method of manufacturing a high-strength martensitic steel, the microstructure was coarse because no intercritical annealing was performed, and DBTT was high.

In Test No. 7-1, a comparative example, corresponding to a case in which contents of carbon, silicon, titanium, and manganese exceed the range of the present disclosure, strength was sufficiently secured and a microstructure was significantly refined. However, it was difficult to sufficiently secure volume percentage of typical martensite and low-temperature toughness was deteriorated due to the increased strength to increase a DBTT.

In Test No. 8-1, a comparative example, in which the contents of carbon, silicon, and niobium were greater than the range of the present disclosure, the contents of manganese and titanium were less than the range of the present disclosure, and aluminum was not included, it was difficult to secure high strength and a DBTT was higher than a reference temperature because there is no aluminum for improving low-temperature toughness.

In Test No. 9-1, a comparative example, in which the contents of manganese and titanium were greater than the range of the present disclosure, sufficient strength and a microstructure were secured, but it was difficult to secure a sufficient volume percentage of typical martensite and DBTT was higher than a reference temperature.

FIG. 2 is a graph illustrating results of a Charpy impact test performed on Test Nos. 5-1 to 5-4 manufactured while varying intercritical annealing conditions. It could be confirmed that although the alloy composition proposed in the present disclosure was satisfied, a DBTT was deteriorated when intercritical annealing conditions are outside of the range proposed in the present disclosure.

While the present disclosure has been shown and described with reference to certain exemplary embodiments thereof, it will be understood by those skilled in the art that various changes in form and details may be made therein without departing from the spirit and scope of the present disclosure as defined by the appended claims.

The invention claimed is:

1. A high-manganese steel comprising:

in terms of weight percentage (wt %), 4.3 to 5.7% of manganese (Mn), 0.015 to 0.055% of carbon (C), 0.015 to 0.05% of silicon (Si), 0.6 to 1.7% of aluminum (Al), 0.01 to 0.1% of niobium (Nb), 0.015 to 0.055% of titanium (Ti), 0.001 to 0.005% of boron (B), 0.03% or less of phosphor (P), 0.02% or less of sulfur (S), and a balance iron (Fe) and other inevitable impurities, wherein a microstructure of the high-manganese steel consists of, in terms of volume percentage, 40 to 60% of martensite and 40 to 60% of tempered martensite, and wherein the martensite has an average grain size of 15 micrometers or less.

2. The high-manganese steel of claim 1, further comprises:

tungsten (W): 0.5% or less (excluding 0%).

3. The high-manganese steel of claim 1, which has yield strength of 550 megapascals (MPa) and tensile strength of 650 MPa or more.

4. The high-manganese steel of claim 1, which has a ductile-brittle transition temperature (DBTT) of −60 degrees Celsius or less.

5. The high-manganese steel of claim 1, which has elongation of 12 percent or more.

* * * * *